US006651648B2

(12) United States Patent
Kuang et al.

(10) Patent No.: US 6,651,648 B2
(45) Date of Patent: Nov. 25, 2003

(54) SMOKE EXHAUSTER

(76) Inventors: Chi-Chung Kuang, 3092 Fisher Court, Coquitlam B. C. (CA), V3E 2R8; Wen Been Li, No. 19-1, Shinyi 2nd St., Shinpu Jen, Hsinchu (TW)

( * ) Notice: Subject to any disclaimer, the term of this patent is extended or adjusted under 35 U.S.C. 154(b) by 66 days.

(21) Appl. No.: 10/086,419

(22) Filed: Mar. 4, 2002

(65) Prior Publication Data

US 2003/0101987 A1 Jun. 5, 2003

(30) Foreign Application Priority Data

Dec. 4, 2001 (TW) ..... 90221087 U

(51) Int. Cl.[7] ..... C02F 11/02
(52) U.S. Cl. ..... 126/299 R
(58) Field of Search ..... 126/299 R, 299 D; 15/4, 1, 3.12; 429/17, 19, 2

(56) References Cited

U.S. PATENT DOCUMENTS

2003/0027023 A1 * 2/2003 Dutil et al. ..... 429/17

* cited by examiner

*Primary Examiner*—Henry Bennett
*Assistant Examiner*—J Barrow
(74) *Attorney, Agent, or Firm*—Rosenberg, Klein & Lee

(57) ABSTRACT

A kitchen smoke exhauster includes a driving device, a pressure-control device, a time-control device, an enzyme-containing device and a spray device assembled together therewith. A natural and harmless enzyme composition contained in a reservoir of the enzyme-containing device is atomized via the spray device to well mix with the discharging oil vapor for decomposition under the control of the driving device and the pressure-control device. Thus, it is capable of preventing the air of our environment from pollution of cooking fume and avoiding the cooking oil residues therein to cause the danger of a fire so as to further protect the health of our lives.

14 Claims, 6 Drawing Sheets

SMOKE EXHAUSTER

BACKGROUND OF THE INVENTION

1. Field of Invention

The present invention relates to a smoke exhauster and more particularly to a kitchen smoke exhauster capable of preventing the air of our environment from pollution of cooking fume and avoiding the cooking oil residues therein to cause the danger of a fire so as to further protect the health of our lives.

2. Description of Related Art

A kitchen smoke exhauster is used to expel the cooking fume outdoors and collect a fewer oil liquidized from the discharged fume in a cup so as to keep the kitchen free from the deposit of the cooking oil vapor. However, conventionally the discharging oily fume will pollute the environment, the oil residue in the oil collecting cup is difficult to clean or dispose as trash, and again the oil residue in the exhauster is easy to cause the fire. Furthermore, the conventional smoke exhausters available in the market today are often limited in that they can not exhaust the cooking fume effectively. It is impossible to reach a 100% fume exhausting effect and sometimes an additional turbulence will influence the fume discharging; therefore, the cooking oil vapor will inevitably escape into the air to harm the healthy of people, and meanwhile the oil will deposit around the exhauster to increase the burden of clearances.

SUMMARY OF THE INVENTION

Therefore, in one aspect, it is an object of the present invention to provide a smoke exhauster with an enzyme-containing sprayer device for decomposing the discharging oil vapor so that the exhausted fume does not pollute the environment.

Another object of the present invention is to provide the smoke exhauster of which the smoke-drawing paths surface fewer oil residues to reduce the possibilities of fire.

Still another object of the present invention is to provide the smoke exhauster without extra filtration nets to be cleaned and disposed.

Still another object of the present invention is to provide the smoke exhauster which the filtration net is left-off so as to prevent the oil deposited thereon from blocking the drawing flow and further reducing the output power of a motor to save power and reduce noise.

According to the above-mentioned objects of the present invention, the smoke exhauster includes a driving device, a pressure-control device, a time-control device, an enzyme-containing device and a spray device assembled together therewith. A natural and harmless enzyme composition contained in a reservoir of the enzyme-containing device is atomized via the spray device to well mix with the discharging oil vapor for decomposition under the control of the driving device and the pressure-control device. As such, the exhausting smoke is almost as clean as the air and will not pollute the environment anymore. Furthermore, the oil residues in the smoke exhauster are possibly disappeared so that the danger of fire can be avoided and the filtration net is not necessary to reduce the burden of clearance. Due to the dispensability of filtration net, the noise and loading of the motor is also lower.

The above and other objects, features and advantages of the present invention will become apparent from the following detailed description taken with the accompanying drawings.

BRIEF DESCRIPTION OF THE DRAWINGS

The present invention will become fully understood from the detailed description given hereinbelow illustration only, and thus are not limitative of the present invention, and wherein.

DETAILED DESCRIPTION OF THE INVENTION

Figure 1:
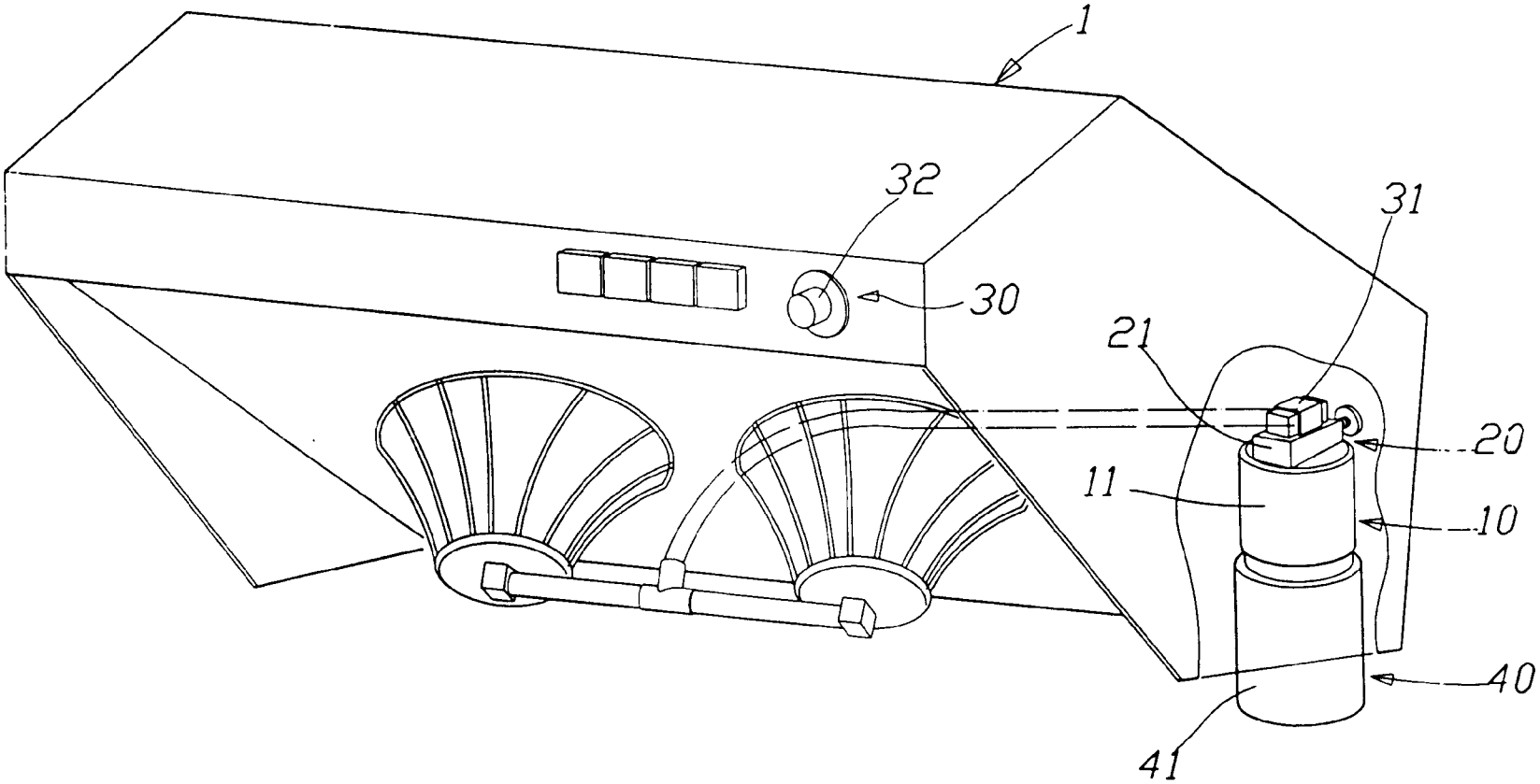
FIG. 1 shows a perspective view showing a preferred embodiment of the smoke exhauster according the present invention.
Figure 2:
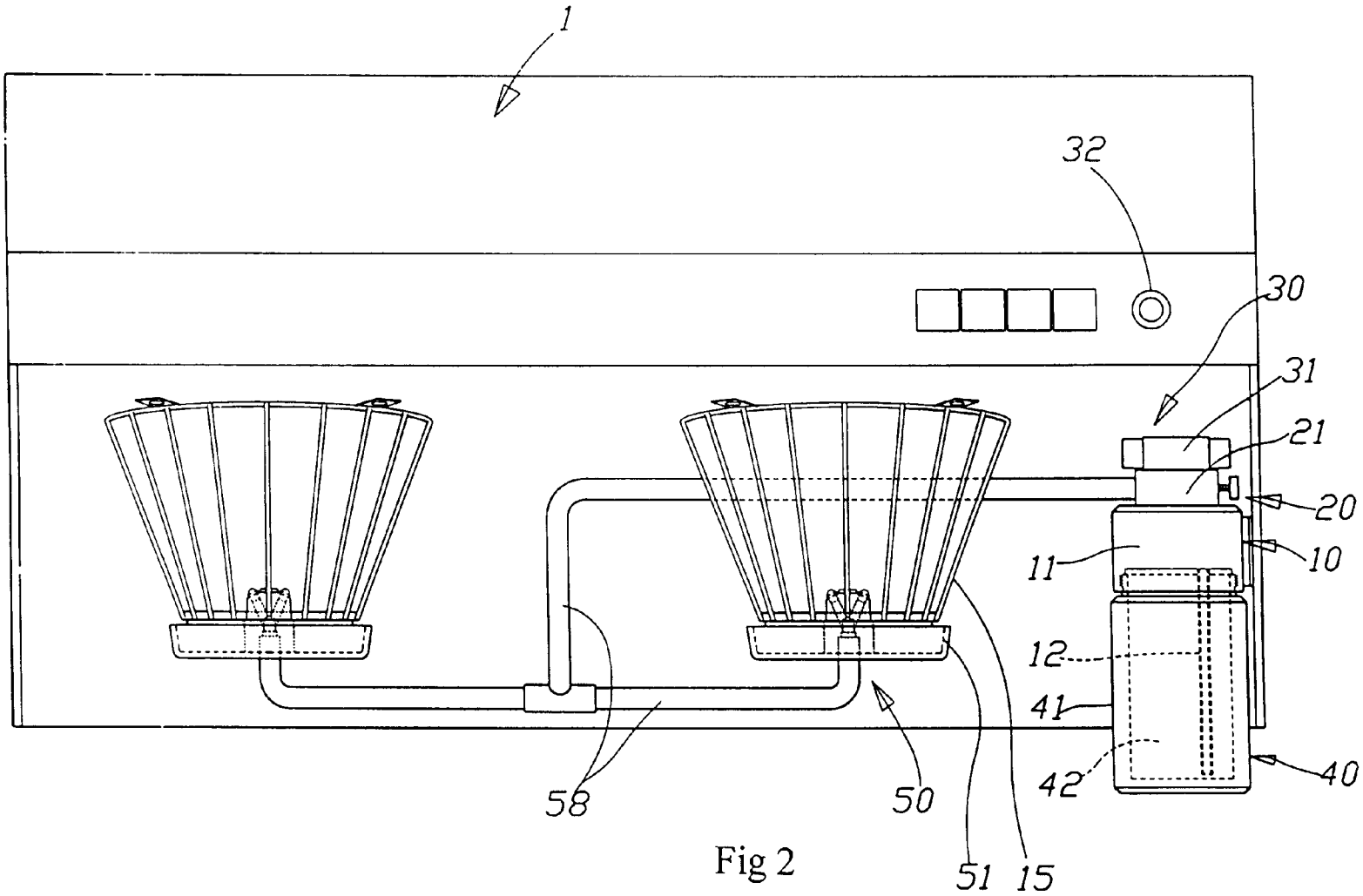
FIG. 2 shows a front plane view of the smoke exhauster in FIG. 1.
Figure 3:
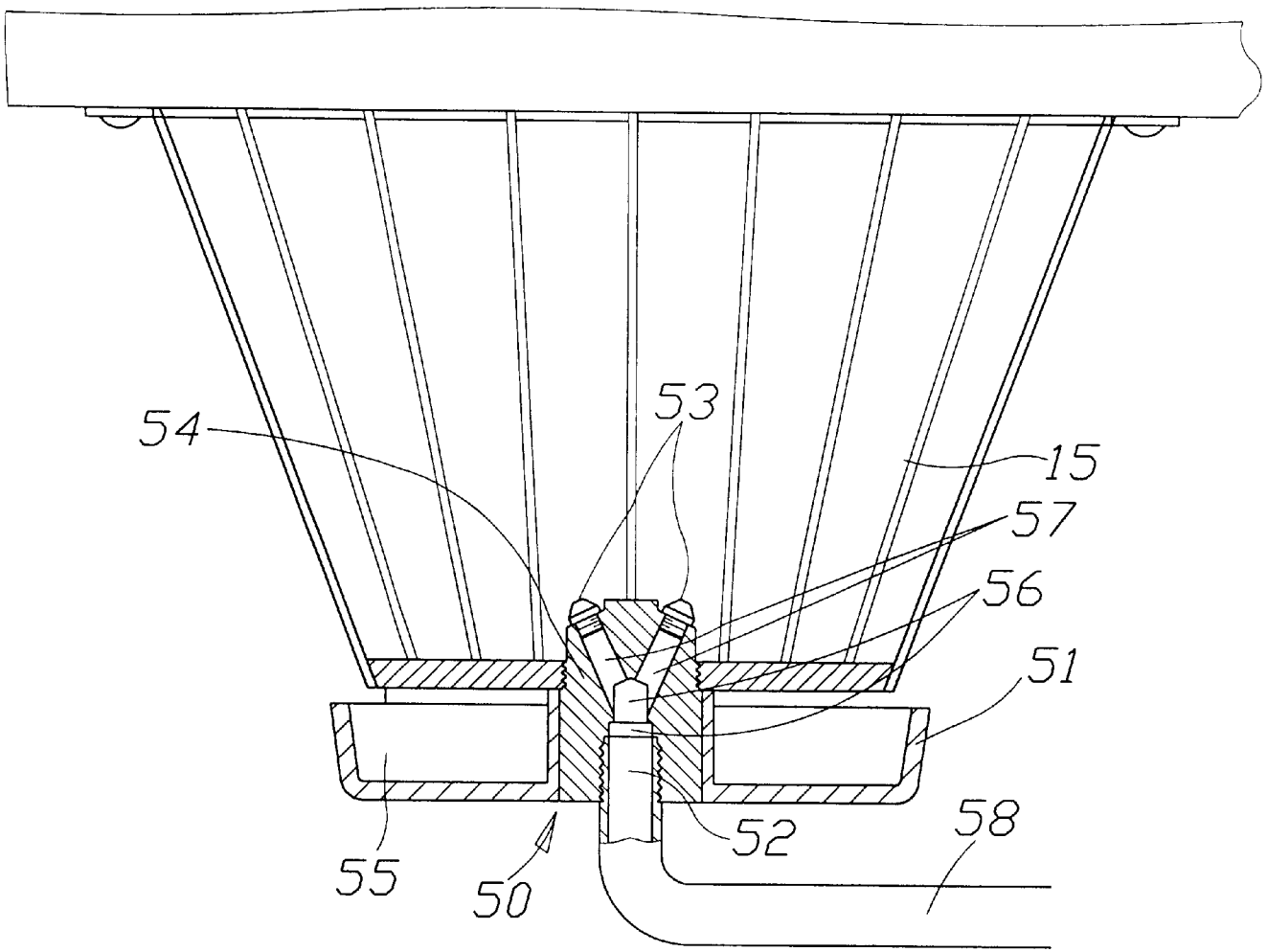
FIG. 3 shows a front plane view of specified assembly of the protecting grill and the spray device in FIG. 2.

Referring to FIGS. 1 to 3, the smoke exhauster of the present invention includes a driving device 10, a pressure-control device 20, a time-control device 30, an enzyme-containing device 40 and a spray device 50 assembled together with the housing of smoke exhauster 1. The driving device 10 includes a pump 11 to connect a sucking tube 12. The pressure-control device 20 is connected to the pump 11 and includes a pressure adjuster 21 for controlling the output of the pump within a suitable pressure value. The time-control device 30 includes an electromagnetic controller 31 and a timer 32. The electromagnetic controller 31 is connected to the pressure adjuster 21 for switching the connection between the conduit of the spray device 50 and the driving device 10. That is, under the control of the electromagnetic controller 31, it can be determined whether to actuate the operation of spray device 50 or not. Next, the timer 32 can be located on the main body 1 of the smoke exhauster for electrically connecting the electromagnetic controller 31 to perform the switching control time. The enzyme-containing device 40 is connected to the driving device 10 and includes a reservoir 41 containing an enzyme composition 42 to supply for the driving device 10. The enzyme composition 42 includes a composition extracting from a natural material, which contains an ingredient for effectively decomposing the oil, mixing with an auxiliary natural material. The sucking tube 12 is inside the reservoir 41 of the enzyme-containing device 40 to reach the enzyme composition 42 absorbed out of the reservoir 41. Furthermore, the spray device 50 includes a collecting tray 51, a spray connector 52 and a nozzle 53. The collecting tray 51 is mounted on a protecting grill 15 surrounding on the smoke-drawing hole (not shown) of the smoke exhauster 1 and includes a hub 54 and an annular groove 55 detachably mounted to the hub 54. There are a spray channel 56 and a passage 57 connected together inside through the hub 54 and there are threads formed on the inner surfaces of the spray channel 56 and the passage 57 to screw spray connector 52 and the nozzle 53 respectively. Thus, the nozzle 53 is mounted to the spray connector 52 through the hub 54 and via the conduit 58 to connect the pressure adjuster 21 of the pressure-control device 20 so that the enzyme composition 42 can be sprayed out of the nozzle 53 in atomization to well mix with the oil vapor for decomposition under the control of the driving device 10, the pressure-control device 20 and the time-control device 30.

Figure 4A:
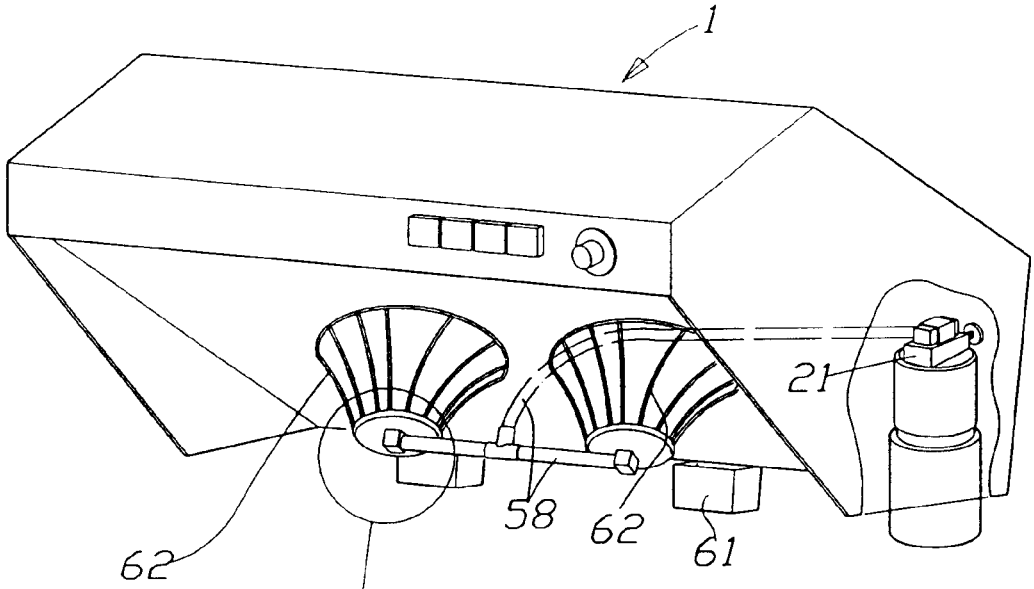
FIGS. 4(*a*) and (*b*) show another preferred embodiment of smoke exhauster according the present invention.
Figure 4B:
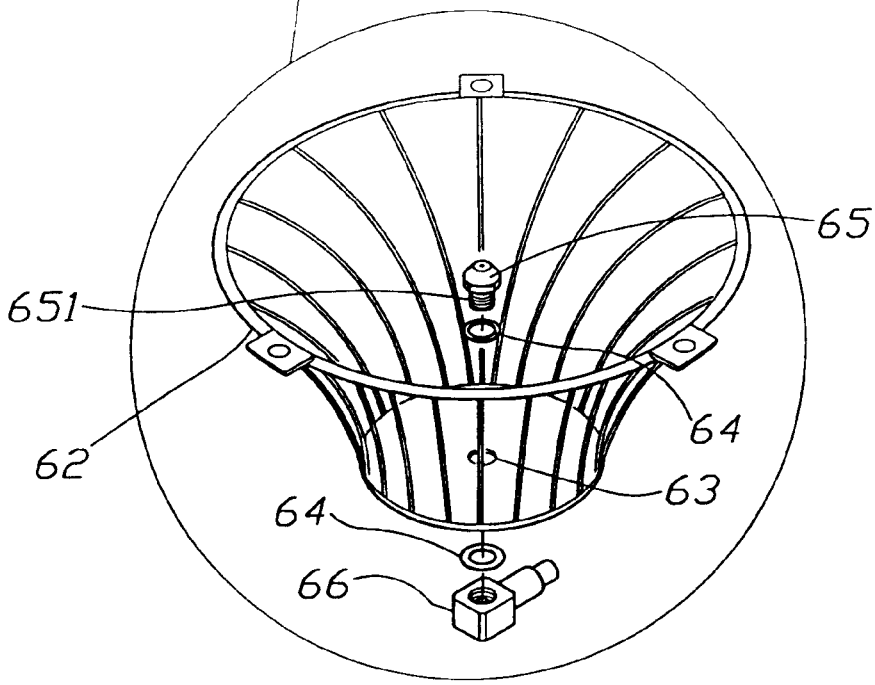

Please refer to FIGS. 4(*a*) and (*b*) which are another preferred embodiment of the present invention. The smoke exhauster 1 includes an collecting cup 61 and a protecting grill 62. The collecting cup 61 is for collecting the residues and the protecting grill 62 is mounted on one of the smoke-drawing hole of the smoke exhauster 1. There is a through hole 63 formed on the bottom surface of the protecting grill 62. A nozzle 65 passes through a retaining ring 64 and the through hole 63 to screw into a corner joint 66 connected to the pressure adjuster 21 via the conduit 58 as above description.

Figure 5:
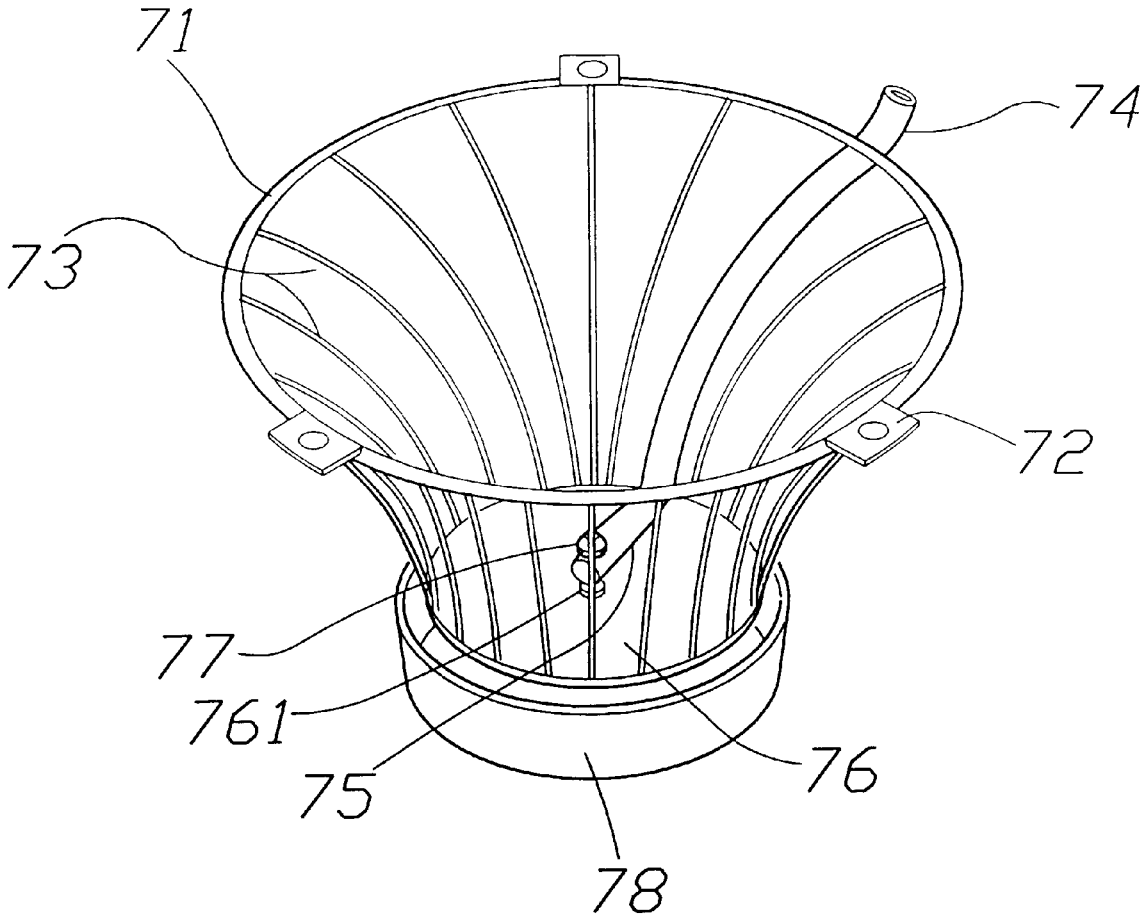
FIG. 5 shows a perspective view of another preferred embodiment of spray device assembly.
Figure 6A:
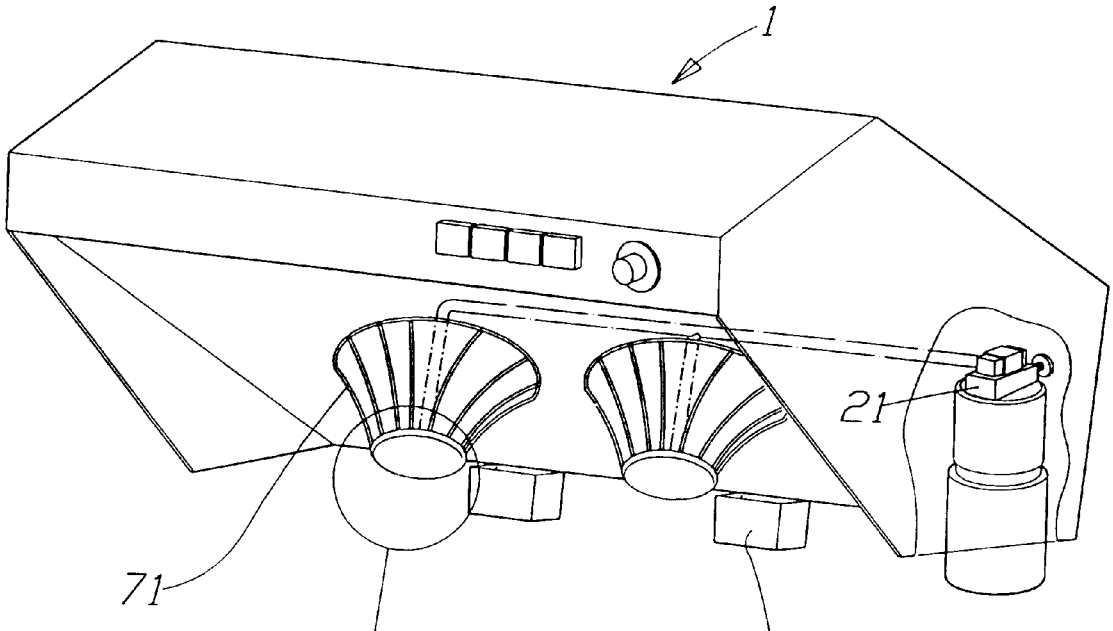
FIGS. 6(*a*) and (*b*) show another preferred embodiment of smoke exhauster according the present invention.
Figure 6B:
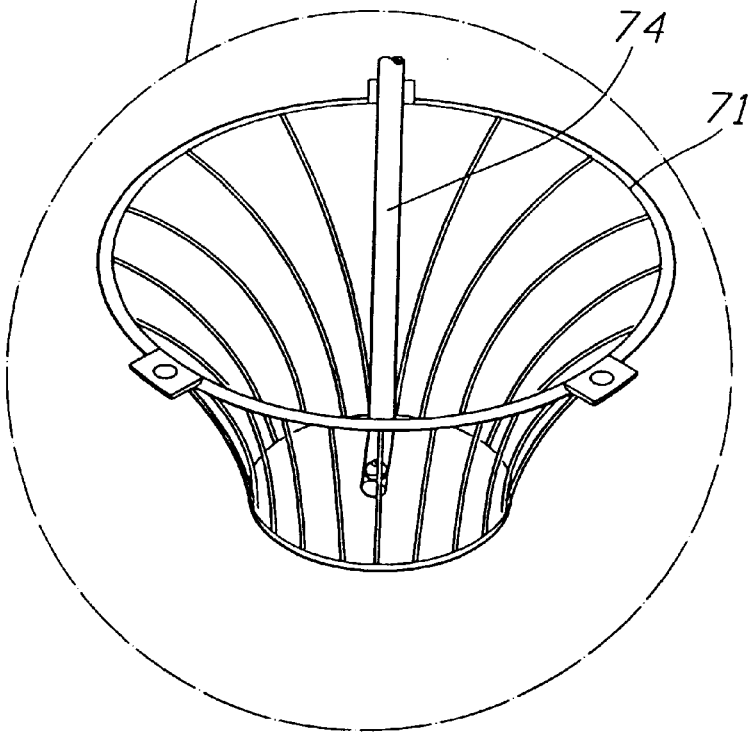

Please refer to FIG. 5 which is another preferred embodiment of the present invention. There are securing members 72 around the annular peripheral of a protecting grill 71 for securing the protecting grill to the smoke exhauster 1. At lease a hose 74 is located around the ribs 73 of the protecting grill 71 for connecting the conduit to the enzyme-containing device 40. It can be as shown in FIG. 5 that a conduit 75 fixedly mounted to a base plate 76 of the protecting grill 71 to connect with the hose 74. It also have a nozzle 77 for spraying out the enzyme composition 42 and a coupling portion 761 on the base plate 76 for coupling the collecting device 78. The collecting device 78 can also be shown as in FIGS. 6(*a*) and (*b*) as another preferred embodiment.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A smoke exhauster for discharging a oil vapor, comprising:

a housing;

a driving device with a pump;

a pressure-control device connected to the driving device, including a pressure adjuster for controlling an output of the pump;

an enzyme-containing device connected to the driving device, including a reservoir containing an enzyme composition to supply for the driving device;

a spray device mounted on the housing, including a nozzle and a conduit connected with a spray connector, wherein the nozzle is mounted to the spray connector via the conduit to connect the pressure-control device so that the enzyme composition is sprayed out of the nozzle to mix with the oil vapor for decomposition under the control of the driving device and the pressure-control device.

2. The smoke exhauster as claimed in claim 1, further comprising a time-control device including an electromagnetic controller connected to the pressure adjuster for switching the connection between the conduit and the driving device.

3. The smoke exhauster as claimed in claim 2, wherein the time-control device further includes a timer mounted on the housing for electrically connecting the electromagnetic controller to perform the switching control.

4. The smoke exhauster as claimed in claim 1, wherein the driving device is fixedly mounted on the housing.

5. The smoke exhauster as claimed in claim 1, wherein the driving device further includes a sucking tube for reaching the enzyme composition being absorbed out of the reservoir.

6. The smoke exhauster as claimed in claim 1, wherein the enzyme composition includes a composition extracting from a natural material, which contains an ingredient for effectively decomposing the oil, mixing with an auxiliary natural material.

7. The smoke exhauster as claimed in claim 1, wherein the spray device further includes a collecting tray mounted on a protecting grill surrounding on a smoke-drawing hole of the smoke exhauster.

8. The smoke exhauster as claimed in claim 7, wherein the collecting tray further includes a hub with a passage and a spray channel connected together therethrough and there are threads formed on the inner surfaces of the passage and the spray channel to screw the nozzle and spray connector respectively.

9. The smoke exhauster as claimed in claim 1, further comprising a protecting grill combining with a collecting cup.

10. The smoke exhauster as claimed in claim 9, wherein the protecting grill further includes a hose to connect the conduit of the spray device.

11. The smoke exhauster as claimed in claim 10, further comprising a joint connected between the hose and another nozzle.

12. An oil collecting device for mounting on a protecting grill of a smoke exhauster, the oil collecting device comprising a hub and an annular groove, wherein a passage and a spray channel connected together are formed through the hub.

13. The oil collecting device claimed in claim 12, wherein the hub and the annular groove are screwed together.

14. The oil collecting device claimed in claim 12, wherein an inner surface of the passage or the spray channel is formed thread thereon.

* * * * *